US005295611A

United States Patent [19]

Simard

[11] Patent Number: 5,295,611

[45] Date of Patent: Mar. 22, 1994

[54] BEVERAGE DISPENSER CODING DEVICE

[75] Inventor: Gilbert Simard, Beauport, Canada

[73] Assignee: Azbar, Inc., Quebec, Canada

[21] Appl. No.: 895,084

[22] Filed: Jun. 8, 1992

[51] Int. Cl.[5] ..... B67D 5/30

[52] U.S. Cl. ..... 222/129.3; 222/129.4

[58] Field of Search ..... 222/129.1, 129.2, 129.3, 222/129.4, 23, 504, 144.5; 364/478, 479

[56] References Cited

U.S. PATENT DOCUMENTS

| | | | |
|---|---|---|---|
| 3,428,218 | 2/1969 | Coja | 222/129.4 X |
| 3,675,820 | 7/1972 | Newberry et al. | 222/129.4 X |
| 3,688,947 | 9/1972 | Reichenberger | 222/129.3 X |
| 3,920,149 | 11/1975 | Fortino et al. | 222/129.3 |
| 3,993,218 | 11/1976 | Reichenberger | 222/129.4 X |
| 4,162,028 | 7/1979 | Reichenberger | 222/129.4 |
| 4,237,536 | 12/1980 | Enelow et al. | 222/129.3 |
| 4,276,999 | 7/1981 | Reichenberger | 222/129.4 |

FOREIGN PATENT DOCUMENTS 2116763 9/1983 United Kingdom .

*Primary Examiner*—Kevin P. Shaver
*Attorney, Agent, or Firm*—Quarles & Brady

[57] ABSTRACT

A non-contact coding device working in a magnetic field, for use with a liquor bottle stopper and electromagnetic valve system. The stopper can be provided with a secondary coil and a diode bridge/rectifier circuit for powering a serial number identifier chip, which serially varies the impedance of the secondary coil. A primary coil on activator unit is coupled with the secondary coil to provide power and read the serial number. The activator unit can also be provided with a number of Hall effect transducers, and the stopper a number of metal peg holes, such that when the transducers are aligned on top of the holes, the presence/absence of metal pegs can be read to reproduce the serial number.

10 Claims, 1 Drawing Sheet

BEVERAGE DISPENSER CODING DEVICE

FIELD OF THE INVENTION

The present invention relates to a beverage dispenser coding device. The invention relates further to a non-contact coding device working in a magnetic field, for use with a liquor bottle stopper and electromagnetic valve system, as is known in U.S. Pat. No. 3,920,149.

BACKGROUND OF THE INVENTION

Beverage dispenser coding devices are known in the art. U.S. Pat. No. 3,920,149 (Fortino et al.) describes a liquor bottle stopper and electromagnetic valve system which has three metal bands on the spout of the stopper whose presence can be detected by use of three detector coils, when the activator coil is energized. This system allows detection of up to seven different kinds of liquor.

In the prior art systems, it is difficult to efficiently detect a large number of different bottles.

SUMMARY OF THE INVENTION

It is an object of the invention to provide a beverage dispenser coding device which is able to encode a large number of different unique objects which can be quickly and efficiently detected in the presence of a magnetic field. It is a further object of the invention to provide such a device at a low cost.

According to the invention, there is provided a beverage dispenser coding device for use with a magnetically activated bottle stopper valve. The device comprises a primary inductance coil provided on an activator coil unit for use in opening the stopper valve, a secondary inductance coil provided on the stopper valve, rectifier means connected to the secondary coil for rectifying and regulating current generated in the secondary coil, serial identifier circuit means connected to the rectifier means for making a pattern of impedance changes in the secondary coil, the pattern being a serial bit pattern representing an identification number, an oscillator connected to the primary coil, and demodulator and decoder means connected to the primary coil for detecting and decoding the pattern to obtain the identification number.

Preferably, the circuit means, the rectifier means and the secondary coil are provided on a printed circuit board. The rectifier means may comprise a diode bridge and a voltage regulator.

According to the invention, there is also provided a beverage dispenser coding device for use with a magnetically activated bottle stopper valve. The device comprises a plurality of Hall effect transducers provided on a base of an activator coil unit for use in opening the stopper valve, a plurality of metal peg receiving means provided on the stopper valve to be proximate the transducers when said activator coil unit is placed on the stopper valve, alignment means for aligning the transducers with respect to the peg receiving means in a predetermined position, and decoder means for reading the transducers when the activator coil is energized to determine whether a metal peg is present in the corresponding metal peg receiving means and thereby to obtain a binary encoded identification number.

Preferably, the transducers are Hall effect microswitches. The alignment means may comprise a wedge shaped tongue and notch arrangement provided on the activator coil unit and the stopper valve. The device may also comprise one extra Hall effect microswitch on the activator coil unit and one extra corresponding metal peg receiving means provided with an extra metal peg on the stopper valve. The extra metal peg is given a different permeability with respect to the extra Hall effect microswitch such that it can be used by timing for determining a position of the extra metal peg. The transducers may be eight in number (excluding the extra one), such that the identification number is between 1 and 255.

DETAILED DESCRIPTION OF THE PREFERRED EMBODIMENTS

Figure 1:
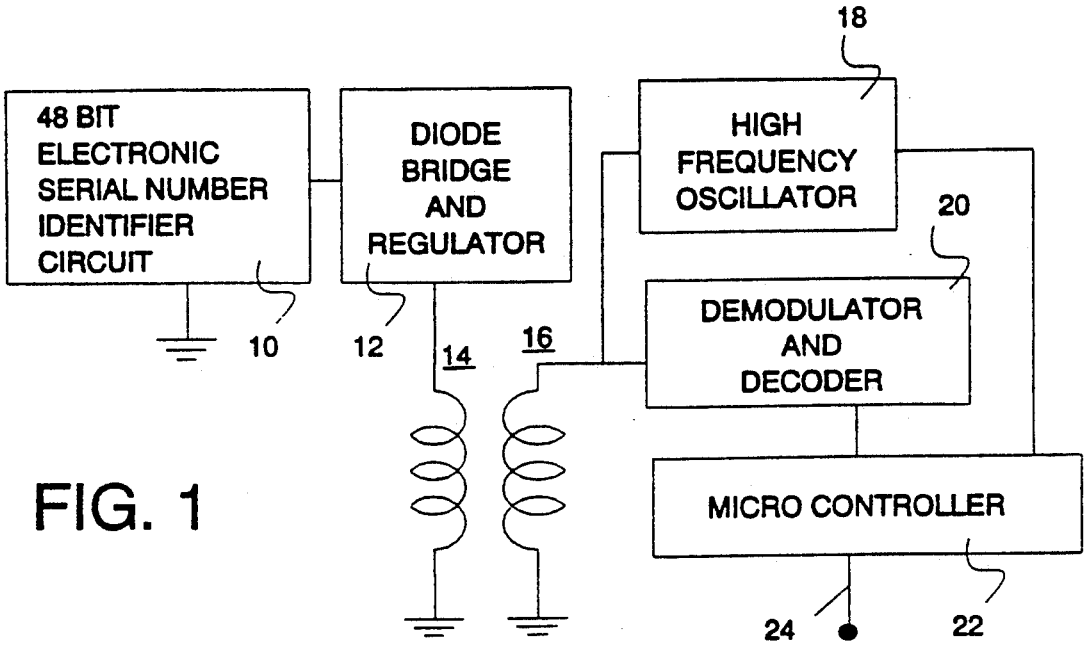
FIG. 1 is a block diagram of the device according to the first preferred embodiment.

In the first preferred embodiment, as shown in FIG. 1, a small printed circuit board is provided on a magnetically activated bottle stopper valve. The printed circuit board has a secondary coil (14) on its upper surface, and a microelectronic diode bridge and voltage regulator circuit (12) mounted on the underside of the board. Also mounted on the underside is an integrated 48 bit serial number identifier circuit (10). Circuit (10) when powered will vary its impedance from 500 kΩ to 5 kΩ in a serial transmission fashion to give out its 48 bit serial number code.

The printed circuit board can be mounted on a shoulder of a conventional magnetically activated bottle stopper valve, and thus can be ring shaped. The conventional stopper valve is described in U.S. Pat. No. 3,920,149, which is incorporated herein by reference. A primary coil (16) is provided on a base of an activator coil unit (not shown) such that when the activator coil unit is placed on the stopper valve, the two coils (14) and (16) form a transformer unit.

A microcontroller (22) gives a signal to a high frequency oscillator (18) to generated a high frequency signal driving coil (16). As the power received by coil (14) is rectified and regulated by means (12), the identifier circuit (10) begin changing the impedance serially and this time varying change in impedance affects the impedance of coil (14) which is detectable on coil (16). The change of impedance of coil (14) is transmitted through coil (16) and then demodulated and decoded by circuit (20). The resulting identification serial number is passed to microcontroller (22) which then outputs the identification number on output (24). Output (24) can be used by a bar control system to know exactly which bottle is being used. This information is used for inventory purposes.

In the first preferred embodiment, the circuit (10) is a DS2400 by Dallas.

Figure 2:
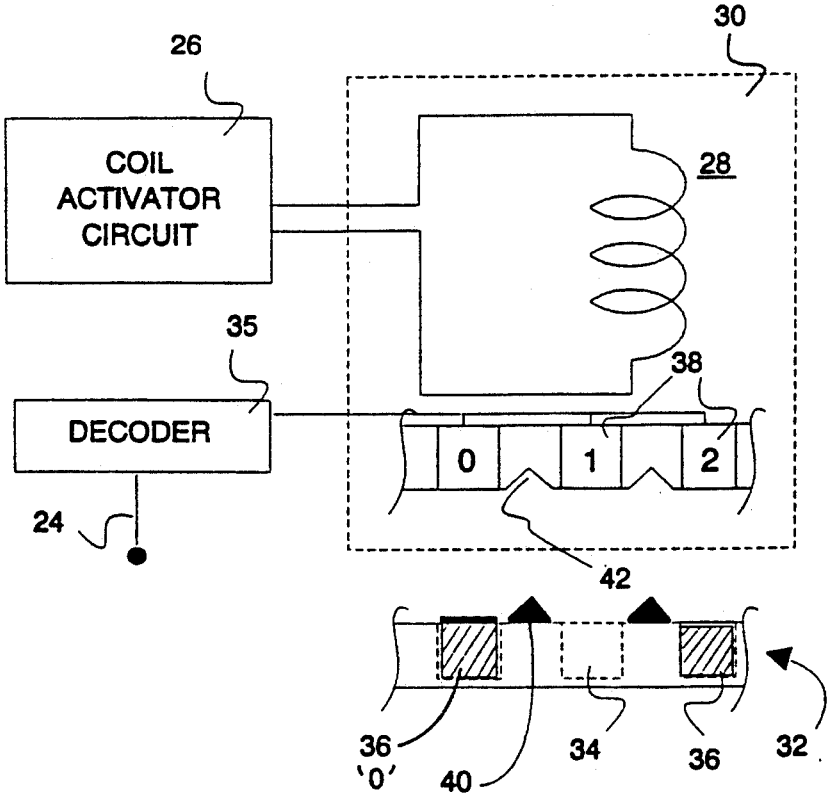
FIG. 2 is a block diagram of the device according to the second preferred embodiment.

In the second embodiment as shown in FIG. 2, the activator coil unit (30) has a coil (28) whose magnetic field serves to open the magnetic valve of the stopper (not shown). In the base of unit (30), nine Hall effect microswitches (38) are provided evenly spaced around its circumference. The stopper (32) is provided with metal peg receiving means (34) which are arranged on a ring like upper surface of the stopper such that when unit (30) sits on stopper (32), the microswitches (38) overlie the means (34). Nine alignment notches (42) are provided in the base of the unit (30) and nine corresponding wedge like tabs (40) are provided on the stopper (32), such that the unit (30) will rest on the stopper (32) in any one of nine given positions. The unit (30) is simply placed on the stopper (32) and rotated a few degrees until the notches (42) mate with the tabs (40).

A first one of the receiving means (34) (the extra one, labelled as '0') is always provided with a metal peg (36), and this metal peg is raised more than the other pegs (36) such that the microswitch (38) located over the '0'peg (36) will change state first when coil (28) is energized to open the valve of the stopper (32). The position of the '0' peg (36) being known, the position and orientation of the other eight receiving means also becomes known. Thus the decoding means (35) quickly establish the presence or absence of pegs (36) in each of the means (34), and the i.d. code of the stopper is easily determined. The Hall effect switches (38) will remain open as the magnetic field of coil (28) is increased over a 50 ms time ramp by activator circuit (26) in the absence of a corresponding metal peg (36), and will close in the presence of the corresponding metal peg (36). The eight states of the presence/absence of the metal pegs (36) provide the eight bit identifier code for the stopper (32). The code output (24) is generated by decoder (35). The Hall effect microswitches are UGN-3140 by Sprague. The 'O' peg (36) can be replaced by a magnet to put the corresponding switch (38) in its active state.

Of course, it is possible to provide only one notch and groove arrangement such that there is only one alignment position in which the unit (30) mates with the stopper (32). In this case, the extra metal peg (36) and microswitch (38) are not required as the positional arrangement will be inherently known.

Although the decoding can take place as coil (28) is energized to open the stopper valve, it is also possible to check the code while energizing coil (28) so as to close the stopper valve (by reverse current), prior to allowing dispensation.

What is claimed is:

1. A beverage dispenser coding device for use with a magnetically activated bottle stopper valve, the device comprising:

a primary inductance coil provided on an activator coil unit for use in opening the stopper valve;

a secondary inductance coil provided on the stopper valve;

rectifier means connected to said secondary coil for rectifying and regulating current generated in said secondary coil;

serial identifier circuit means connected to said rectifier means for making a pattern of impedance changes in said secondary coil, said pattern being a serial bit pattern representing an identification number;

an oscillator connected to said primary coil; and demodulator and decoder means connected to said primary coil for detecting and decoding said pattern to obtain the identification number.

2. Device as defined in claim 1, wherein said circuit means, said rectifier means and said secondary coil are provided on a printed circuit board.

3. Device as defined in claim 1, wherein said rectifier means comprise a diode bridge and a voltage regulator.

4. A beverage dispenser coding device for use with a magnetically activated bottle stopper valve, the device comprising:

a plurality of Hall effect transducers provided on a base of an activator coil unit for use in opening the stopper valve;

a plurality of metal peg receiving means provided on the stopper valve to be proximate said transducers when said activator coil unit is placed on the stopper valve;

alignment means for aligning said transducers with respect to said peg receiving means in a predetermined position; and decoder means for reading said transducers when the activator coil is energized to determine whether a metal peg is present in said corresponding metal peg receiving means and thereby to obtain a binary encoded identification number.

5. Device as defined in claim 4, wherein said transducers are Hall effect microswitches, the device further comprising one extra Hall effect microswitch on said activator coil unit and one extra corresponding metal peg receiving means provided with a metal peg on said stopper valve, the extra metal peg having a different permeability as seen by the extra microswitch such that the extra Hall effect microswitch will change state at a different time, whereby said decoder means can determine a position of the extra metal peg by said different time.

6. Device as defined in claim 4, wherein said alignment means comprise a wedge shaped tongue and notch arrangement provided on said activator coil unit and said stopper valve.

7. Device as defined in claim 6, wherein said transducers are Hall effect microswitches, said alignment means comprise as many wedge shaped tongue and notch arrangements as there are metal pegs, and the device further comprises one extra Hall effect microswitch on said activator coil unit and one extra corresponding metal peg receiving means provided with a metal peg on said stopper valve, the extra metal peg having a different permeability as seen by the extra microswitch such that the extra Hall effect microswitch will change state at a different time, whereby said decoder means can determine a position of the extra metal peg by said different time.

8. Device as defined in claim 7, wherein said transducers are eight in number, whereby said identification number is between 1 and 255.

9. Device as defined in claim 5, wherein said extra metal peg is raised with respect to its neighboring metal pegs, such that the extra Hall effect microswitch will change state before said neighboring metal pegs.

10. Device as defined in claim 7, wherein said extra metal peg is raised with respect to its neighboring metal pegs, such that the extra Hall effect microswitch will change state before said neighboring metal pegs.

* * * * *